United States Patent [19]

Camp et al.

[11] 4,239,561

[45] Dec. 16, 1980

[54] PLATEAU PROPELLANT COMPOSITIONS

[75] Inventors: Albert T. Camp, Welcome, Md.; Elmer R. Csanady, Washington, D.C.; Paul R. Mosher, Indian Head, Md.

[73] Assignee: The United States of America as represented by the Secretary of the Navy, Washington, D.C.

[21] Appl. No.: 421,363

[22] Filed: Nov. 29, 1973

[51] Int. Cl.[3] ..... C06B 45/10

[52] U.S. Cl. ..... 149/19.8; 149/88; 149/93; 149/96; 149/100; 149/92

[58] Field of Search ..... 149/92, 93, 88, 98, 149/96, 19.8, 100

[56] References Cited

U.S. PATENT DOCUMENTS 3,228,338 1/1966 McEwan et al. ..... 149/98 X

*Primary Examiner*—Stephen J. Lechert, Jr.

*Attorney, Agent, or Firm*—R. S. Sciascia; A. L. Branning

[57] ABSTRACT

The addition of monobasic cupric $\beta$-resorcylate to a double base propellant plasticized by only nitrate esters having primary nitroxy groups in order to obtain a plateau burning characteristic.

10 Claims, 2 Drawing Figures

PLATEAU PROPELLANT COMPOSITIONS

BACKGROUND OF THE INVENTION

This invention relates generally to gas production compositions and more particularly to double base propellants not having an energetic plasticizer with secondary nitroxy groups.

The burning rate equation for double base propellants is given as $r=KP^n$ or $\log r=n \log P+\log K$ where r is the burning rate, P is the combustion chamber pressure, K is a constant for each propellant composition, and n is a constant for non-modified propellants but is a variable function in plateau propellants varying from very high positive values through zero to low negative values. Thus, a plot of log r against log P would give a straight line with a slope of n for a non-modified propellant, but a "plateau" shaped line for plateau propellants.

The plateau logarithmic relationship between the burning rate and the chamber pressure is greatly preferred over the linear logarithmic one. Such a relationship gives better ballistic and combustion stability, less dependence on initial temperature, and lower peak pressures in the combustion chamber.

In order to obtain the plateau relationship, additives referred to as ballistic modifiers are included in the propellant composition. These additives accelerate the burning rate at low pressures but have a decreasing catalytic effect as the chamber pressure increases up to a certain pressure. Then the decreasing catalytic effect diminishes and the rate-pressure relationship slowly approaches the rate-pressure relationship for the propellant without the modifier. Sometimes the rate-pressure function for the plateau propellant actually remains below that of the unmodified propellant.

Excellent plateau burning has been obtained for double base propellants plasticized by nitrate esters having secondary nitroxy groups, e.g., nitroglycerin. On account of the greater strength of the bond between a primary carbon and a nitroxy group, only moderate success has been obtained in formulating plateau double base propellants which are plasticized by an ester with only primary nitroxy groups. This is becoming an extremely serious problem to the propellant art because of increasing recognition of the superiority of the latter plasticizers and particularly of the energetic plasticizeer consisting of metriol trinitrate (MTN) and triethylene glycol dinitrate (TEGDN). Propellants made with the MTN-TEGDN plasticizer are vastly superior in health, stability, and storage considerations than propellants utilizing nitroglycerin as a plasticizer. For example such propellants have been stored for more than one year at 175° F. without any appreciable loss in performance. This represents a storage life of at least three to four times that of nitroglycerin propellants.

The limited amount of plateau burning for this latter class of double base propellants has been achieved by the addition of large amounts, i.e., amounts in excess of two weight percent of certain lead and other metallic salts. Lead salicylate, lead β-resorcylate, lead ethyl hexoate lead stannate, and lead acetylsalicylate have given the best results. Since these ballistic modifiers give results barely sufficient, the other ten or so known ballistic modifiers are not used in scaled up propellant systems unless mixed with the above lead salts.

The use of lead salts in any amount is objectionable on account of the health hazards caused by lead oxides in the exhaust gas and because of the problem of contamination of the worker's skin and clothing. A disadvantage of any metallic salt in the quantities now being used in the propellants contemplated by this invention is the increase in visibility of the exhaust due to the increase in the solids content of the exhaust gas.

OBJECTS OF THE INVENTION

Accordingly one of the objects of this invention is to provide a composition capable of being used as a gun or a missile propellant or in an auxiliary gas producing device.

Also an object of this invention is to provide a propellant composition which is easily prepared, safe to handle, and capable of being formed in a wide variety of grains and shapes with a long storage life.

Also an object of this invention is to provide a double base propellant with a primary nitrated plasticizer having a minor performance change over a temperature range of −40° to 140° F.

Another object of this invention is to provide a double base propellant with a primary nitrated plasticizer having a ballistic modifier which begins to catalyze at around 700 psia.

Another object of this invention is to provide a double base propellant with a primary nitrated plasticizer having a nearly constant burning rate over a pressure range of 1000 to 3000 psia.

Another object of this invention is to provide a double base propellant with a primary nitrated plasticizer giving only around 0.15 weight percent of solids in the exhaust gas.

Still another object of this invention is to provide a plateau double base propellant with a primary nitrated plasticizer having no toxic or visible exhaust.

And still another object is to provide a double base propellant with a primary nitrated plasticizer having no lead oxides in the exhaust.

And yet another object of this invention is to provide a plateau double base propellant with a primary nitrated plasticizer having superior stability.

These and other objects can be achieved by the addition of monobasic cupric β-resorcylate within the determined critical limits to a double base propellant plasticized with a primary nitrated ester.

DESCRIPTION OF THE PREFERRED EMBODIMENTS

Figure 1:
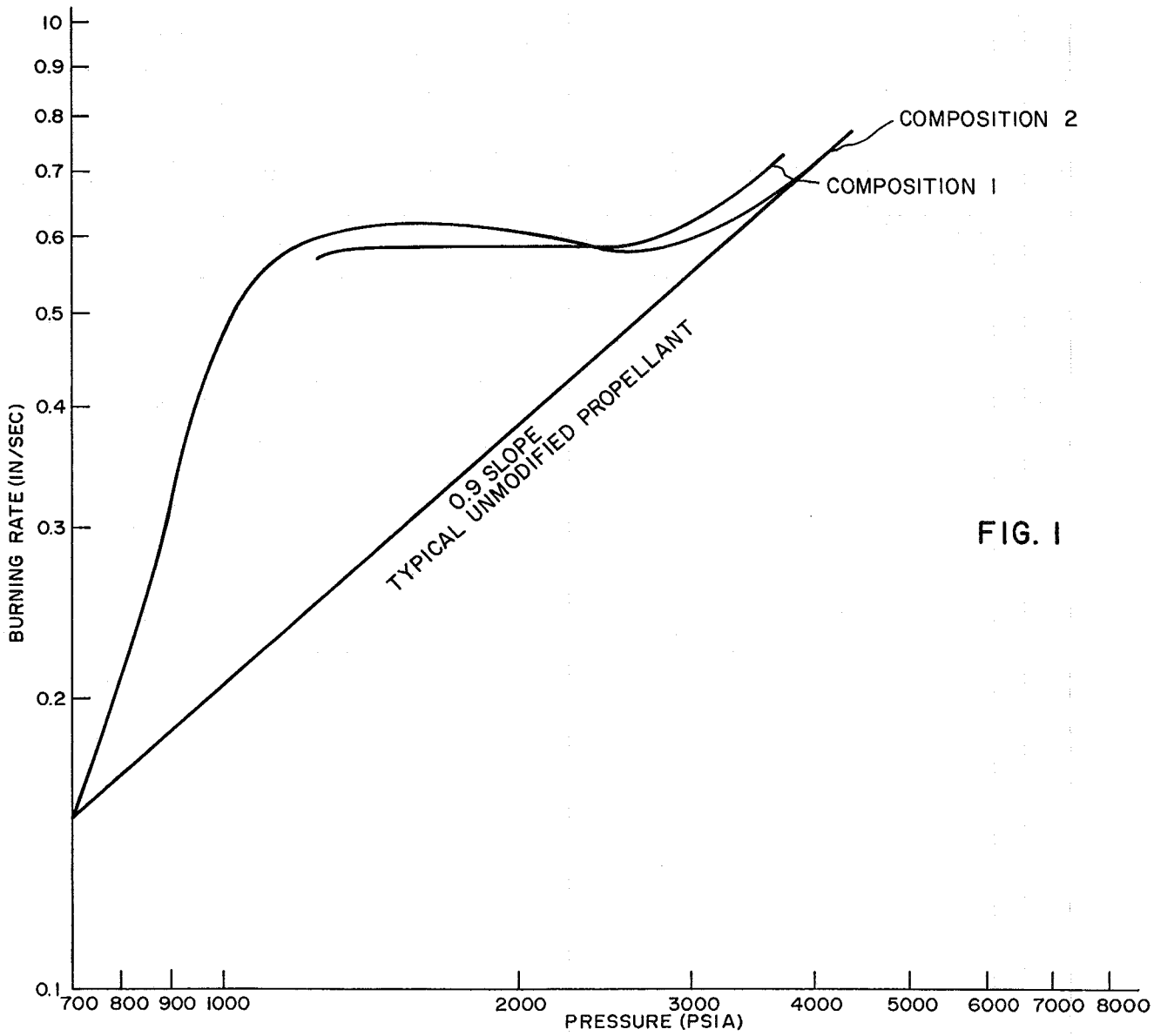
FIG. 1 is a comparison of the burning characteristics of example compositions 1 and 2 with a comparable unmodified propellant.

The effectiveness of a ballistic modifier is judged by the starting point of the catalytic action and especially by the width and height of the plateau. It is not understood why monobasic cupric β-resorcylate should be so strikingly better than the currently used ballistic modifiers for double base propellants plasticized primary bonded nitrate esters. However, the criticality of the amount, the marked superiority of monobasic cupric β-resorcylate over the corresponding lead resorcylate, and the superiority of the copper resorcylate over copper salicylate seem to indicate that the ultraviolet rays produced by the vaporization of copper during combustion are being absorbed in an enormous amount by the resorcylate ligand. This is only a possible explanation and is not meant to bind the present invention to any explanation. Other factors undoubtedly contribute to the plateau burning phenomenon. Such factors include the strength of chelation, the modifier's ability to be nitrated or nitrosated readily or be altered or activated by reaction with $NO_2$ radicals in the foam and fizz zones, and the degree of compatibility with the other ingredients of the propellant. Although the exact mechanism is not understood, it is clear that exceptional compositions have been obtained by the use of monobasic cupric β-resorcylate.

The amount of the ballistic modifier of this invention can be between 0.2 to 2 weight percent with 0.5 to 1.5 weight percent preferred and 0.7 to 1.0 weight percent the most preferred. This modifier can be used with a large number of art recognized double base ingredients. The binder may be nitrocellulose (NC), plastisol nitrocellulose (PNC), polyvinyl nitrate (PVN), polyvinyl acetate (PVA), cellulose acetate (CA), mixtures thereof and the like. Preferrably nitrocellulose is used and has a nitration between 12 and 13% and a viscosity of 1 to 25 seconds by standard test of a 10% solution in acetone. The amount of nitrocellulose may be 35 to 65 weight percent with 45 to 55 weight percent preferred.

The plasticizer may be for example pentaerythritol trinitrate (PETRIN), diethylene glycol dinitrate (DEGN), metriol trinitrate (MTN), triethylene glycol dinitrate (TEGDN), mixtures thereof, and the like. The preferred plasticizer is a mixture of MTN and TEGDN in a MTN/TEGDN ratio of 5:1 to 10:1 with 7:1 to 8:1 the most preferred. The amounts to be used can be 20 to 60 weight percent of MTN with 30 to 50 weight percent the most preferred and 2 to 15 weight percent of TEGDN with 4 to 10 weight percent the most preferred.

The preferred stabilizer for the propellants encompassed by this invention is 2-nitrodiphyenylamine (2-NDPA) or ethyl centralite (EC) in an amount of 0.5 to 5 weight percent with 1.5 to 3 weight percent the most preferred. Other good stabilizers are N-alkyl paranitroanilines.

A nonenergetic plasticizer may also be used with this invention. The preferred nonenergetic plasticizer would be di-n-propyl adipate in an amount from about 1 to about 5.0 weight percent with 1 to 3 weight percent preferred.

Other ingredients may be used to adapt the propellant to a particular processing method or a particular use. For example candelilla wax may be added as an extrusion aid.

The general nature of the invention having been set forth the following examples are presented as specific illustrations thereof.

TABLE I

| COMPOSITION (WEIGHT PERCENT) | | | |
|---|---|---|---|
| Component | Ex. 1 | Ex. 3 | Ex. 2 |
| NC (12.6% N) | 40.0 | 51.2 | 51.0 |
| MTN | 50.0 | 40.0 | 41.0 |
| TEGDN | 7.0 | 5.0 | 5.0 |
| 2-NDPA | 2.0 | 2.0 | 2.0 |
| di-n-propyl adipate | — | 1.0 | — |
| monobasic cupric β-resorcylate | 1.0 | 0.7 | 1.0 |
| Candelilla wax | — | 0.1 | — |

A solventless method of preparation is to be preferred over solvent method of preparation. Solvents have a detrimental effect on the copper salt and solvent processes are more time consuming and difficult. Further a solventless method gives a more homogenous product.

By way of example the following method of preparation is given. This is the method of preparation of the examples given in Table I. Nitrocellulose, warm water, and 2-NDPA are mixed to a fine slurry. Next the plasticizer is slowly added to the slurry. Thereafter the slurry is dried and aged for at least one day at a temperature around 130° F. Further drying reduces the moisture content to around 10%. At this time monobasic cupric β-resorcylate is added and the mixture is milled to a homogeneous colloid on a differential rolling mill. If extrusion is desired, the propellant can be easily extruded to any desired shape.

The data for the curves of the buring rate-pressure relationship were obtained by standard techniques. A strand of propellant was burned in a Crawford bomb. Recordings were made of the time, length of strand, and the nitrogen gas pressure inside of the bomb. From this data the burning rates and the average recorded pressures were calculated.

Figure 2:
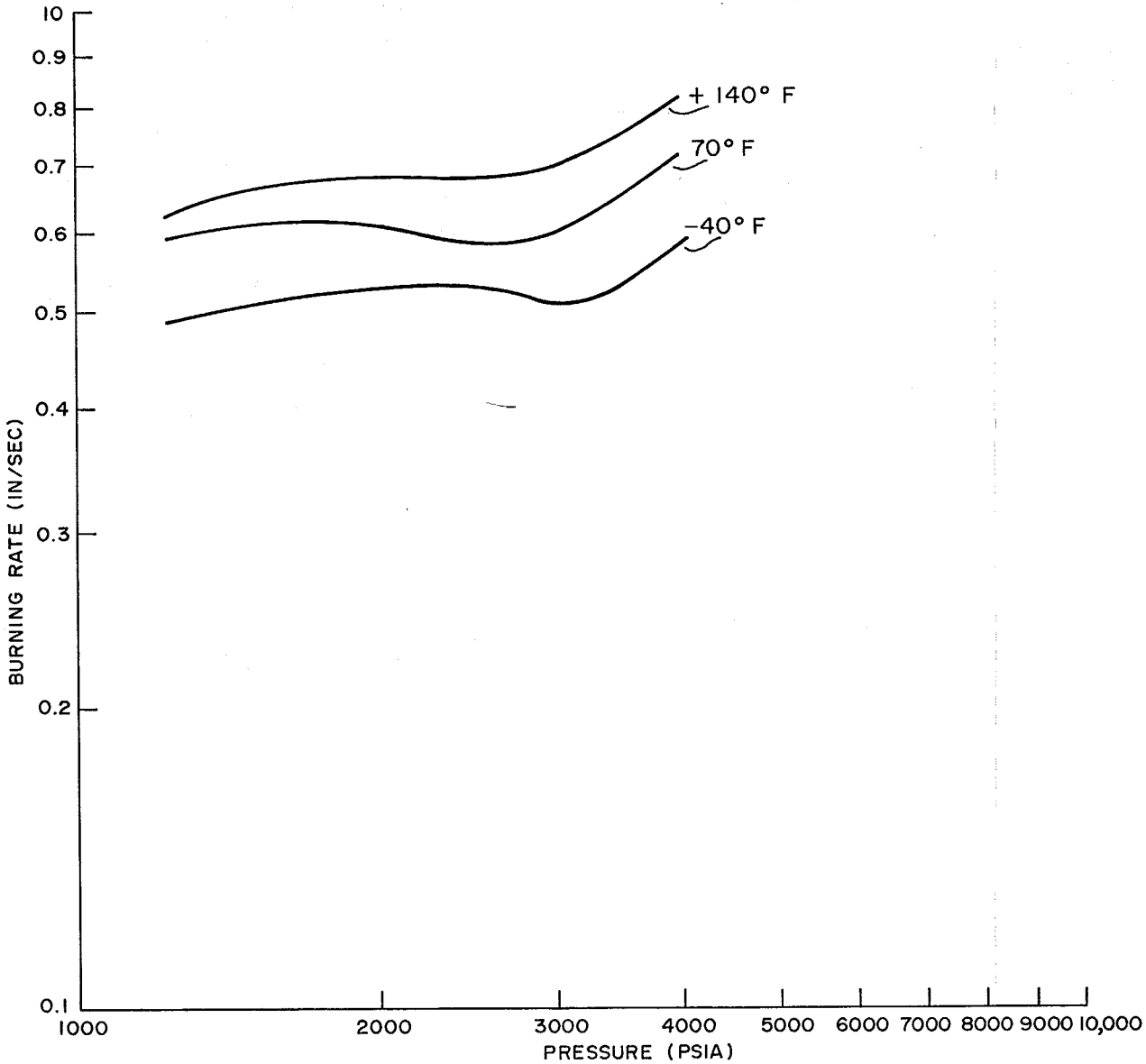
FIG. 2 shows the variation in performance of example composition 3 over a temperature range of −40° to 140° F.

The burning rate-pressure curves of FIG. 1 shows the remarkable catalytic effects of the monobasic cupric β-resorcylate in composition examples 1-2. A strong positive catalytic effect is produced roughly between 700 and 1100 psia by this salt. Then the copper salt has a reduced catalytic effect up to around 3000 psia. Thereafter the catalytic effect slowly diminishes. FIG. 2 reveals the remarkable insensitivity of example composition 3 to changes in the initial temperature. Hence it is seen that this invention provides double base propellants plasticized by primary bonded nitrate esters which are remarkably insensitive to temperature changes and which exhibit plateau burning characteristics comparable to those of double base propellants plasticized by nitroglycerin and containing 4% or more of the lead compounds.

Obviously, many modifications and variations of this invention are possible in the light of the above teachings. It is therefore to be understood that within the scope of the appended claims the invention may be practiced otherwise than as specifically described.

The weight percentages of the components of the compositions in the specification and claims are by weight of the entire composition.

What is claimed as new and desired to be secured by Letters Patent of the United States is:

1. In a double base propellant plasticized by primary bonded nitrate esters, the improvement comprising adding about 0.2 to about 2 weight percent of monobasic cupric β-resorcylate as a ballistic modifier.

2. The improved propellant of claim 1 wherein 0.5 to 1.5 weight percent of monobasic cupric β-resorcylate is added.

3. The improved propellant of claim 1 wherein 0.7 to 1 weight percent of monobasic cupric β-resorcylate is added.

4. A double base propellant composition comprising a binder, a plasticizer selected from the group consisting of pentacrythritol trinitrate (PETRIN), diethylene glycol dinitrate (DEGDN), metriol trinitrate (MTN), triethylene glycol dinitrate (TEGDN), and mixtures thereof, and about 0.2 to about 2 weight percent of monobasic cupric β-resorcylate.

5. The propellant of claim 4 wherein said binder constitutes from about 35 to about 65 weight percent of nitrocellulose (NC), said plasticizer consists of about 20 to about 60 weight percent of metriol nitrate (MTN) and from about 2 to about 15 weight percent of triethylene glycol dinitrate (TEGDN).

6. The propellant of claim 4 wherein said binder constitutes 45 to 55 weight percent of nitrocellulose (NC), the plasticizer comprises 30 to 50 weight percent of metriol trinitrate (MTN) and 4 to 10 weight percent of triethylene gylcol dinitrate (TEGDN), and monobasic cupric resorcylate constitutes 0.5 to 1.5 weight percent.

7. The propellant of claim 6 wherein the monobasic cupric $\beta$-resorcylate comprises from about 0.7 to about 1.0 weight percent of the composition, and the composition additionally contains from about 1.5 to about 3 weight percent of 2-nitrodiphenylamine, and from about 1 to about 3 weight percent of di-n-propyl adipate.

8. A method of producing a plateau burning characteristic in a double base propellant plasticized by primary bonded nitrate esters comprising adding from about 0.2 to about 2 weight percent of monobasic cupric $\beta$-resorcylate.

9. The method of claim 8 wherein the weight percentages of monobasic cupric $\beta$-resorcylate is 0.5 to 1.5.

10. The method of claim 8 wherein the weight percentage of monobasic cupric $\beta$-resorcylate is 0.7 to 1.0.

* * * * *